US008769826B2

(12) United States Patent
Wu

(10) Patent No.: US 8,769,826 B2
(45) Date of Patent: Jul. 8, 2014

(54) CUTTING DEVICE

(76) Inventor: Yuewei Wu, Ninghai (CN)

( * ) Notice: Subject to any disclaimer, the term of this patent is extended or adjusted under 35 U.S.C. 154(b) by 103 days.

(21) Appl. No.: 13/545,993

(22) Filed: Jul. 11, 2012

(65) Prior Publication Data

US 2014/0013605 A1 Jan. 16, 2014

(51) Int. Cl.
*B26B 1/08* (2006.01)

(52) U.S. Cl.
USPC ..... 30/162; 30/2; 30/125

(58) Field of Classification Search
USPC ..... 30/162, 335
See application file for complete search history.

(56) References Cited

U.S. PATENT DOCUMENTS 3,176,395 A * 4/1965 Warner et al. ..... 30/154
3,999,290 A * 12/1976 Wood ..... 30/2
4,139,939 A * 2/1979 Crooks ..... 30/2
4,835,865 A * 6/1989 Knoop ..... 30/162
5,617,635 A * 4/1997 Berns ..... 30/162
5,813,121 A * 9/1998 Gringer ..... 30/162
6,044,562 A * 4/2000 Dillenbeck ..... 30/162
6,058,607 A * 5/2000 Gringer ..... 30/162
6,148,520 A * 11/2000 Berns ..... 30/2
6,161,290 A * 12/2000 Takamasa ..... 30/162
6,233,830 B1 * 5/2001 Lamond et al. ..... 30/123
6,263,577 B1 * 7/2001 Wonderley ..... 30/152
6,418,624 B1 * 7/2002 Huang ..... 30/162
6,550,144 B1 * 4/2003 Berns ..... 30/162
6,553,673 B2 * 4/2003 Peyrot et al. ..... 30/162
6,775,911 B2 * 8/2004 Tremblay ..... 30/162
6,785,966 B2 * 9/2004 Berns ..... 30/2
6,949,109 B2 * 9/2005 Iske et al. ..... 606/167
7,316,070 B2 * 1/2008 Green ..... 30/162
7,540,092 B2 * 6/2009 Polei ..... 30/162
7,596,868 B2 * 10/2009 Berns ..... 30/162
7,596,869 B2 * 10/2009 Berns ..... 30/162
7,765,701 B2 * 8/2010 Okada ..... 30/162
8,220,161 B2 * 7/2012 Chang ..... 30/162
8,549,755 B2 * 10/2013 Ranieri et al. ..... 30/162
8,567,070 B2 * 10/2013 Rowlay et al. ..... 30/162
8,567,071 B2 * 10/2013 Strauss ..... 30/162
2002/0029482 A1 * 3/2002 Peyrot et al. ..... 30/162
2003/0019109 A1 * 1/2003 Tremblay ..... 30/162
2003/0159290 A1 * 8/2003 Berns ..... 30/2
2005/0193568 A1 * 9/2005 Peyrot et al. ..... 30/162
2007/0283570 A1 * 12/2007 Huang ..... 30/162
2009/0106983 A1 * 4/2009 Berns ..... 30/162
2009/0277016 A1 * 11/2009 Wu ..... 30/162
2011/0232104 A1 * 9/2011 Ho ..... 30/162
2011/0283542 A1 * 11/2011 Wu ..... 30/162
2013/0091712 A1 * 4/2013 Schekalla ..... 30/162
2014/0013605 A1 * 1/2014 Wu ..... 30/162

* cited by examiner

*Primary Examiner* — Hwei C Payer

(57) ABSTRACT

A cutting device with an auto-retractable blade, having a housing containing an active blade extendable from a front aperture thereof and a spare blade box therein. An actuator is provided being fixed to an actuator seat contained in and slidable with respect to the housing. The actuator seat has a side protrusion having a front dent defined therein. A blade seat is slidably contained in the housing. The blade seat has an upper fulcrum, a side protrusion, a side blocker, a blade installation plate, a lower fulcrum, and a blade seat return spring. The side protrusion has a front slope and a back tip which is receivable in the front dent of the actuator seat.

2 Claims, 3 Drawing Sheets

CUTTING DEVICE

BACKGROUND OF THE INVENTION

1. Field of the Invention

The invention relates to a cutting device, and more particularly, to a cutting device having both an auto-retractable blade and a spare blade box contained in a housing thereof.

2. Description of the Prior Art

Cutting device is a commonly used hand tool for cutting, e.g., wood, paper, leather, plastic panel, cord, and cardboard. It often has a housing made up of two covers detachably coupling together. The housing acts as both a handle and a container for a blade slidably received therein. An actuator is provided in an aperture defined in the handle for moving the blade.

In order to avoid hurting persons after cutting, some utility knives having auto retractable blade are provided. A blade of the cutting device is able to retract back into the housing when a user releases the actuator after cutting. However, dangers still exist when a user, who is abstracted or not agile enough to release the actuator, waves the cutting device to himself or other with his finger pressing on, the actuator and the blade extending after leaves a workpiece.

Cutting devices with a retractable blade in which the blade automatically retracts into the handle before a clumsy user can bring it toward himself or toward anyone else after a cutting edge of the blade leaves a workpiece are disclosed in U.S. Pat. No. 7,765,701 and U.S. Patent Application Publication No. 2009/0277016. Both cutting devices have a blade seat having a long tail extending backward and a hook formed on an also backward extending pole driven by a thumb actuator. In work, a user is able to move the actuator forward, and the hook will drive the long tail, thus the blade seat, forward, too. When the blade cuts the workpiece, the blade seat rotates and the long tail leaves the hook. As the blade leaves the workpiece, the blade seat is driven back by a spring. When the user releases the actuator, the pole is driven back by another spring and engages with the long tail again for next time use.

It is a trend for current utility knives that they all need to have an integral spare blade box defined in the housing thereof. A cutting device lack of integral spare blade box brings much inconvenience. However, all prior automatically retractable utility knives do not have such a spare blade box. The long tail and the backward extending pole occupy much of a rear portion of the housing, which usually belongs to, the spare blade box. Since the rotation of the blade in cutting is a very tiny one, a journey of travel of the backward extending pole to disengage with the long tail of the blade seat in cutting must be enlarged by a leverage mechanism. In another words, if there were not the long tail and the backward extending pole, a distance between the actuator and the blade seat before and after the cutting is too small for the actuator to credibly engage with the blade seat.

BRIEF SUMMARY OF THE INVENTION

The main object of the invention is to provide a cutting device an active blade of which is able to automatically retract into a housing after the active blade leaves a workpiece and before a user of the knife releases an actuator for extending the blade, and which has a sufficient space in a house thereof for a spare blade box without increase a whole volume thereof.

Another object of the invention is to provide a cutting device with an auto-retractable blade which is able to firmly stop at any desirable position between a fully extended and the retracted positions.

In accordance with one aspect of the invention, there is provided a cutting device having:

- a housing, the housing having a left cover, a right cover coupling to the left cover, a front aperture for extension of an active blade, a rear portion thereof defining a space for storage of spare blades, and a lower cover being able to cover the space,
- an actuator seat contained in and reciprocally slidable along the housing, the actuator seat having an actuator return spring with one end fixed to the actuator seat and the other end fixed to an inner surface of the housing, more than one rib, and one bottom protrusion, the bottom protrusion having a front dent defined thereon,
- an actuator extending from the housing and fixed to the actuator seat,
- a blade seat slidably contained in the housing, the blade seat having an upper fulcrum, a side protrusion, a side blocker, a blade installation plate having elasticity, a lower fulcrum, and a blade seat return spring having one end fixed to the blade seat and the other end fixed to the inner surface of the housing the blade installation plate having a rear end fixed to the blade seat and a front end having a side finger and a blade installation pillar formed thereon, the side protrusion having a front slope and a back tip which is receivable in the front dent of the actuator seat,
- a blade change means having an inner protrusion formed on the inner surface of the housing facing the side finger of the blade installation plate, a top button having a central pivot, a rear end, and a front end leaving a distance to the housing and, a blade locking means having a sliding bar contained in the housing and a button extending from the housing.

These and other objectives, features, and advantages of the present invention will become apparent from the following detailed description, the accompanying drawings, and the appended claims.

DETAILED DESCRIPTION OF THE PREFERRED EMBODIMENT

Figure 1:
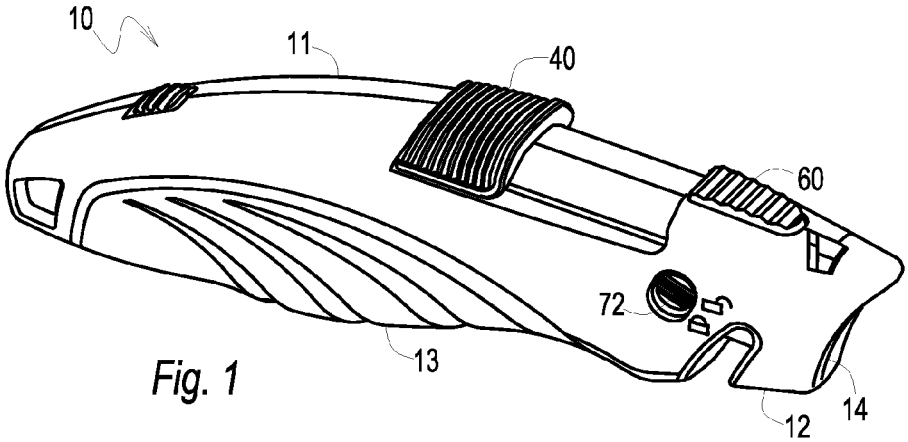
FIG. 1 is a perspective schematic view of the preferred embodiment of the cutting device of the invention.
Figure 2:
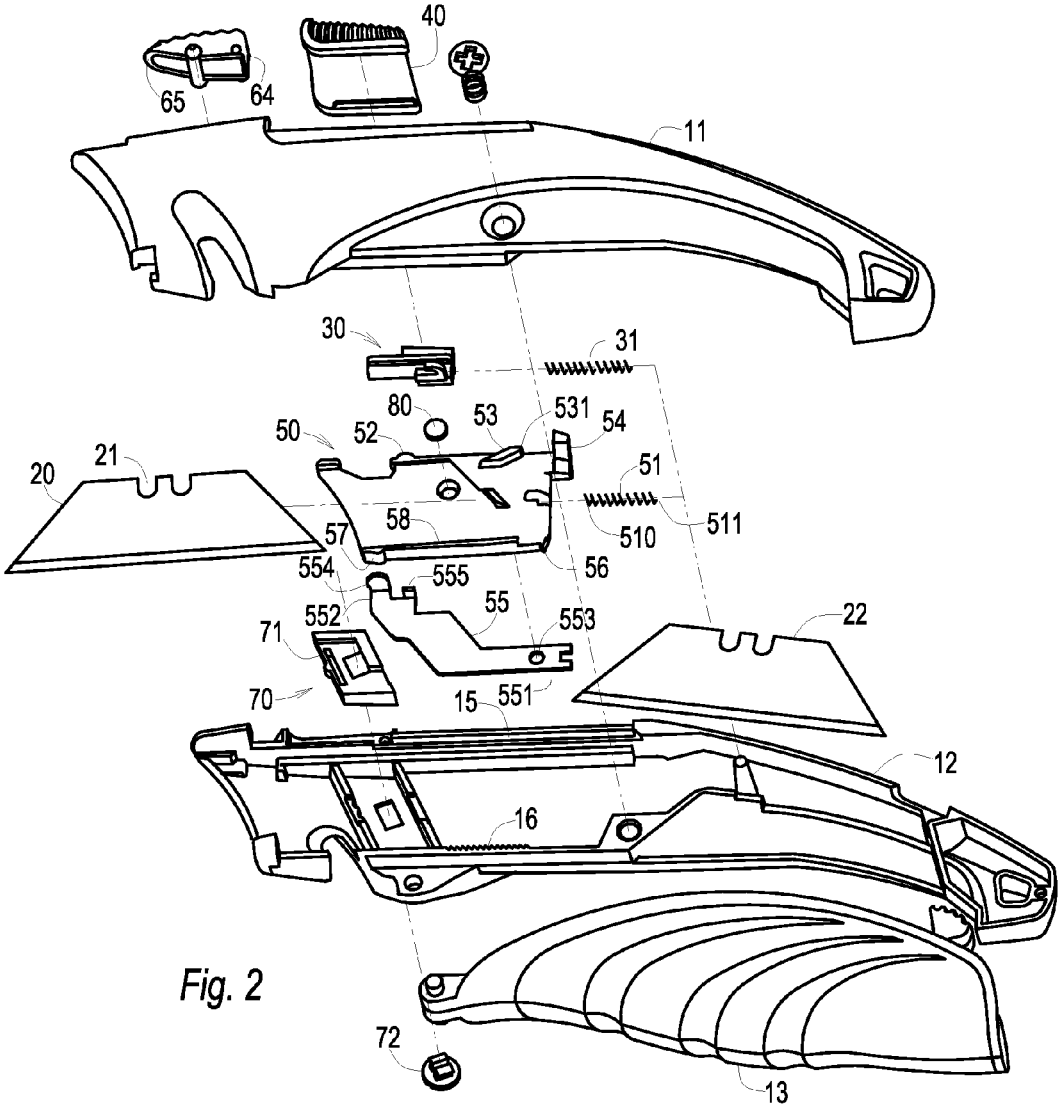
FIG. 2 is an exploded perspective view showing the cutting device shown in FIG. 1.

With reference to FIGS. 1 and 2, a cutting device of the preferred embodiment of the invention is shown. The cutting device has a housing 10 made up of a left cover 11, a right cover 12 coupling to the left cover 11, and a lower cover 13 detachably coupling to the left and the right covers 11, 12, an active blade 20 slidably received in the housing 10 and being able to extend via a front aperture 14 defined in the housing 10, an actuator seat 30 contained in and reciprocally slidable along the housing 10, an actuator 40 extending from the housing 10 and fixed to the actuator seat 30 for controlling the active blade 20 to extend, an actuator return spring 31 having one end fixed to the actuator seat 30 and the other end fixed to an inner surface of the housing 10, a blade seat 50 slidably contained in the housing 10 for installation of the active blade 20, a blade seat return spring 51, a blade change means 60, and a blade locking means 70. The housing 10 acts as both a container for the blade 20 and a handle.

Figure 3:
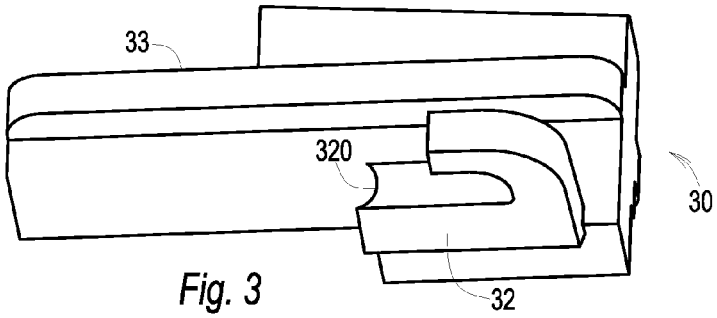
FIG. 3 is an enlarged perspective view of an actuator seat of the cutting device shown in FIG. 2.

With reference to FIG. 2, the actuator 40 is fixed to the actuator seat 30 and when the actuator 40 is pushed forward, the actuator seat 30 moves forward accordingly against the actuator return spring 31. The actuator return spring 31 will be able to pull back the actuator seat 30 when a user releases the actuator 40. As particularly shown in FIG. 3, the actuator seat 30 has one bottom protrusion 32 and one or more ribs 33 which are able to engage into corresponding guiding slits 15 defined in the inner surface of the left and the right covers 11, 12 to ensure a stable sliding of the actuator seat 30 with respect to the housing 10. The bottom protrusion 32 of the actuator seat 30 has a front dent 320 defined thereon.

The blade seat 50 is able to longitudinally slide with respect to the housing 10. The blade seat 50 has an upper fulcrum 52, a side protrusion 53, a side blocker 54, a blade installation plate 55, a lower nib 56, and a lower fulcrum 57. The blade installation plate 55 has a rear end 551 which is fixed to the blade seat 50 with a rivet 553 and a front end 552 having a side finger 554 and a blade installation pillar 555 which is able to engage with a notch 21 of the active blade 20 in installation. The blade installation plate 55 is made of hard material having a certain elasticity such as steel. A front end 510 of the blade seat return spring 51 is fixed to the blade seat 50 and a rear end 511 thereof is fixed to the housing 10 in such a deployment that the rear end 511 is higher than the front end 510. The blade seat 50 may have one or more ribs 58 which are able to engage into corresponding guiding slits (not shown) defined in the inner surface of the left and the right covers 11, 12 to ensure a stable sliding of the blade seat 50 with respect to the housing 10. The side protrusion 53 has a front slope 530 and a back tip 531 which is, receivable in the front dent 320 of the actuator seat 30. One row of teeth 16 may be defined in the inner surface of the housing 10 to which the lower nib 56 of the blade seat 50 is able to engage.

Figure 4A:
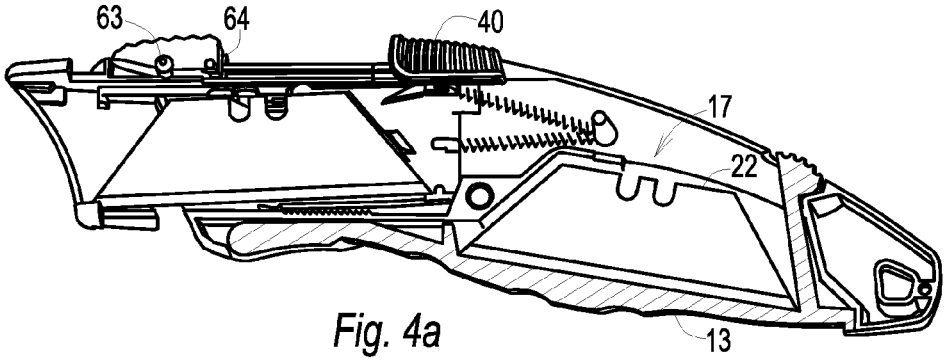
FIGS. 4*a* to 4*e* are partial schematic perspective views showing working of the cutting device.
Figure 5A:
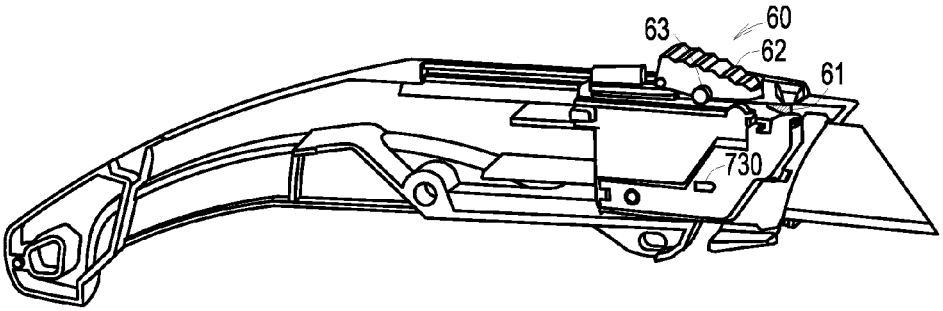
FIG. 5*a* is a schematic perspective views showing a process of blade change. And, FIG. 5*b* is an enlarged schematic perspective view showing the blade and a blade seat in the process of blade change shown in FIG. 5*a*.

With reference to FIGS. 1, 2 and 4*a*, a rear portion of the housing 10 defines a space 17 as a spare blade box and the lower cover 13 acts as a cover of this space 17. Spare blades 22 are able to be stored in the space 17. The blade locking means 70 has a sliding bar 71 contained in the housing 10, a button 72 extending from the housing 10 for control the sliding bar 71 to reciprocally move across the housing 10, and a side blocker 730 (as shown in FIG. 5*a*) formed on the blade seat 50. In locking of the active blade 20, a user is able to move the button 72 to a locking position in which the sliding bar 71 enters a way of the side blocker 730. At this time, the side blocker 73 is stopped by the sliding bar 71 and the blade seat 50 will no longer able to move forward with respect to the housing 10. The active blade 20 is not able to extend and the cutting device is in a safe mode. When the user move the button 72 to an unlocking position in which the sliding bar 71 leaves the way of the side blocker 730, the blade seat 50 and the sliding bar 71 formed thereon will be able to move freely and the active blade 20 will be able to be extended. The cutting device is in a use mode. Blade locking is prior art and will not described in further detail herein.

Figure 4B:
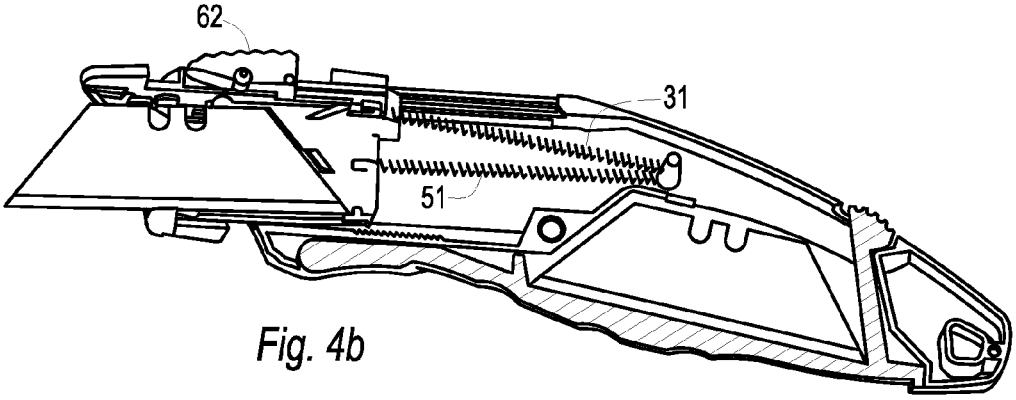

With reference to FIG. 4*a*, an operation of the cutting device will be described in detail. In a spare status as shown in the Fig., the actuator seat 30, and the actuator 40 fixed thereto, are pulled by the actuator return spring 31 and stopped by the side blocker 54 of the blade seat 50. With reference to FIG. 4*b*, a work status of the cutting device is shown. The actuator 40 is pushed forward by a thumb of the user to a work position. The actuator seat 30, which is fixed to the actuator 40, moves forward accordingly against the actuator return spring 31. When the actuator seat 30 moves, the front dent 320 thereof drives the back tip 531 of the side protrusion 53, thus the blade seat 50, to move forward at the same time against the blade seat return spring 51.

Figure 4C:
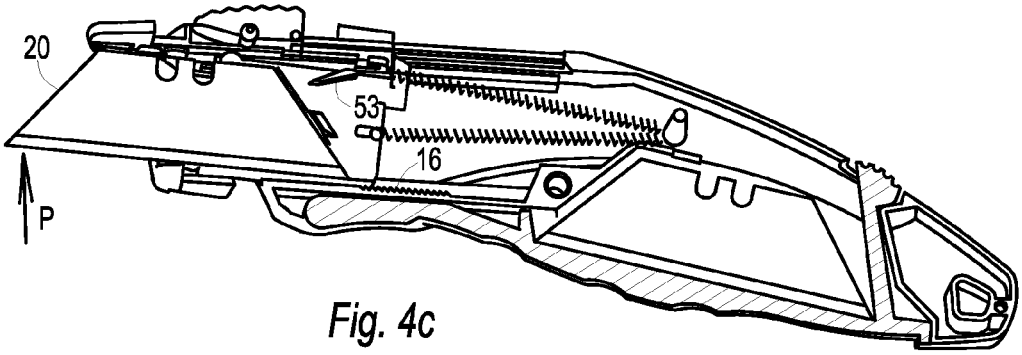

Further with reference to FIG. 4*c*, when the user cuts a workpiece (not shown in the Fig.) with the active blade 20 extended, a knifepoint portion of the active blade 20 gets a upright force P, which may force the active blade 20 and the blade seat 50 to rotates about the upper fulcrum 52 of the blade seat 50. As the blade seat 50 rotates, the back tip 531 of the side protrusion 53 on the blade seat 50 leaves the front dent 320 of the actuator seat 30, and the lower nib 56 of the blade seat 50 meets and is blocked by the row of teeth 16 on the housing 10. As long as the actuator 40 is pushed by the user to stay at the work position, any movement of the blade seat 50, thus the active blade 20 fixedly installed thereon, will be stopped by the lower nib 56 engaging to the teeth 16 on the housing 10.

Figure 4D:
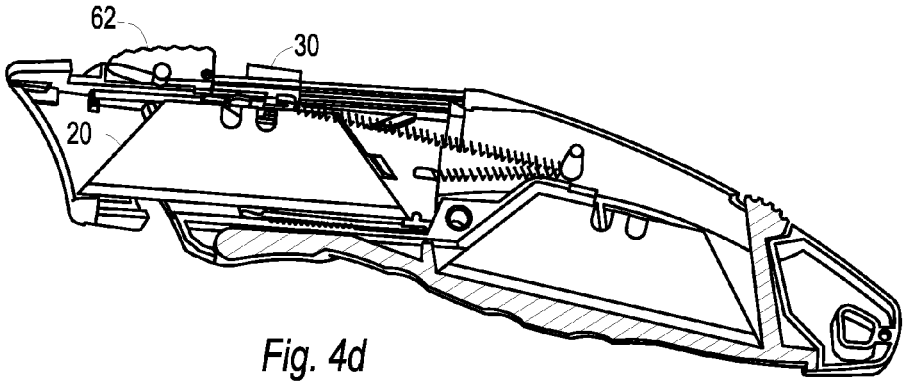
Figure 4E:
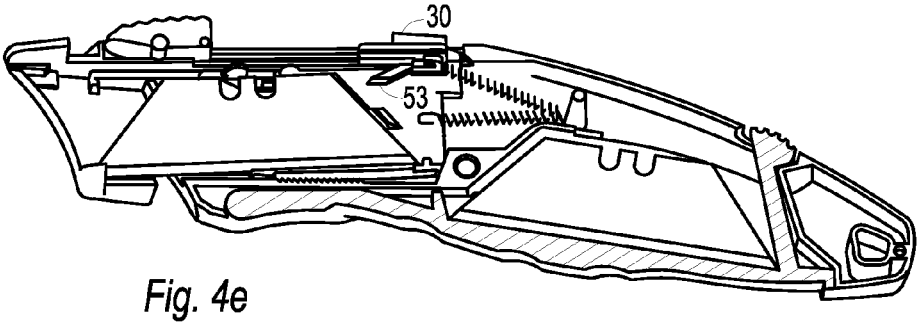

As shown in FIG. 4*d*, as soon as the active blade 20 leaves the workpiece after cutting force P disappears. The blade seat 50 counter-rotates about the upper fulcrum 52 thereof under the upright resuming force of the blade seat return spring 51. In the counter-rotation, the lower nib 56 of the blade seat 50 will leave the teeth 16 of the housing 10. Once the lower nib 56 leaves the teeth 16, the blade seat 50 will be pulled to move backward by the blade seat return spring 51 to a spare status as shown. Thus, it could be seen that the active blade 20 of the cutting device of the invention is able to automatically retract into the housing 10 after the active blade 20 leaves the workpiece and before the user intentionally releases the actuator 40 to retract the active blade 20.

After the blade seat 50 stops at the spare position, the user may release the actuator 40. The actuator 40 and the actuator seat 30 will then be pulled to move backward by the actuator return spring 31. In the movement, the bottom protrusion 32 of the actuator seat 30 goes along the blade seat 50 towards the side protrusion 53. As the bottom protrusion 32 meets the front slope 530 of the side protrusion 53, the blade seat 50 will be pushed by the bottom protrusion 32 to rotate about the lower fulcrum 57 thereof against the blade seat return spring 51. After the bottom protrusion 32 passes the side protrusion 53 the blade seat 50 reversely rotates about the upper fulcrum 52 under a resuming force of the blade seat return spring 51 and the back tip 531 of the side protrusion 53 engages to the front dent 320 of the bottom protrusion 32 again. The cutting device of the invention thus resumes the spare status as shown in FIG. 4*a* and is able to be used for the next time. Back to FIG. 2, a magnet 80 may be fixedly installed on the blade seat 50 on a surface facing the active blade 20. The magnet 80 is able to make the active blade 20, which is ferrous, stabler with respect to the blade seat 50.

Figure 5B:
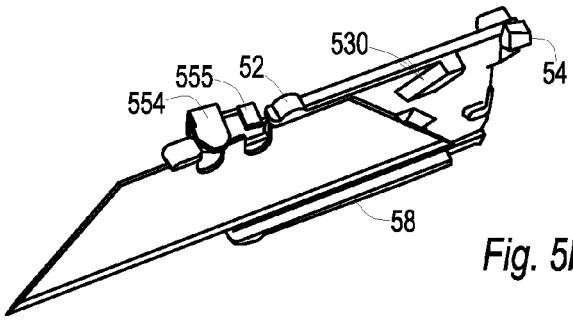

With reference to FIGS. 5*a* and 5*b*, a working of the blade change means 60 will be described hereinafter in detail. The blade change means 60 has an inner protrusion 61 formed on the inner surface of the housing 10 facing the side finger 554 of the blade installation plate 55, and a top button 62 having a central pivot 63 rotatably installed on the housing 10, a rear end 64 in a way of the actuator seat 30, and a front end 65 leaving a tiny distance to the housing 10. As particularly shown in FIG. 5*a*, when the user needs to change an active blade 20, he is able to push the front end 65 of the top button 62 down and then the rear end 64 will move upward and leave the way of the actuator seat 30. The actuator seat 30 then is able to be pushed forward until the side finger 554 meets the inner protrusion 61. Keep pushing the actuator 40, the side finger 554 of the blade installation plate 55, which has a certain elasticity, will go along the inner protrusion 61 and thus push the front end of the blade installation plate 55 to deflect away from the blade seat 50 and the active blade 20. As shown in FIG. 5*b* when the actuator 40 is pushed to the front most position, the deflection of the front end of the blade installation plate 55 will be just able to make the blade installation pillar 555 leave and disengage with the notch 21 of the active blade 20. The active blade 20 is then able to be pulled out from the blade seat 50 and replaced. After the replacement, the user is able to release the actuator 40 and then push the rear end 64 of the top button 62 down back to the work position for the next use.

It could be seen from above description, that without an enlargement effect of the long tail leverage, a touching area between the bottom protrusion 32 and the side protrusion 53 is very small since a journey of the side protrusion 53 bring by the rotation of the blade seat 50 is much smaller than that of the long tail however, the back tip 531 and the front dent 320 are able to provide a credible engagement with a small contact area. They are not liable to detach from each other. As a result, the long tail is able to be saved for space to receive a spare blade box.

What is claimed is:

1. A cutting device comprising:

a housing, said housing having a left cover, a right cover coupling to said left cover, a front aperture for extension of an active blade, a space for storage of spare blades in a rear portion thereof, and a lower cover being able to cover said space, an actuator seat contained in and reciprocally slidable along said housing, said actuator seat having an actuator return spring with one end fixed to said actuator seat and the other end fixed to an inner surface of said housing, more than one rib, and one bottom protrusion, said bottom protrusion having a front dent defined thereon, an actuator extending from the housing and fixed to said actuator seat, a blade seat slidably contained in said housing said blade seat having an upper fulcrum, a side protrusion, a side blocker, a blade installation plate having elasticity, a lower fulcrum, and a blade seat return spring having one end fixed to said blade seat and the other end fixed to the inner surface of said housing, said blade installation plate having a rear end fixed to said blade seat and a front end having a side finger and a blade installation pillar formed thereon, said side protrusion having a front slope and a back tip which is receivable in said front dent of said actuator seat, a blade change means having an inner protrusion formed on said inner surface of said housing facing said side finger of said blade installation plate, a top button having a central pivot, a rear end, and a front end leaving a distance to said housing, and, a blade locking means having a sliding bar contained in said housing, and a button extending from said housing.

2. The cutting device as claimed in claim 1, wherein said housing further has a row of teeth and the blade seat further has a lower nib which is able to engage to one of said teeth.

* * * * *